US006215455B1

(12) United States Patent
Lamata D'Angelo et al.

(10) Patent No.: US 6,215,455 B1
(45) Date of Patent: Apr. 10, 2001

(54) ARMORED MAGNETIC FIELD ANTENNA IN PRINTED CIRCUIT

(75) Inventors: Patricia Lamata D'Angelo, Marseilles; Yves Le Nevez, Trets; Pierre Andre Collet, Grenoble; Philippe Porte, Aix en Provence, all of (FR)

(73) Assignee: Gemplus S.C.A., Gemenos (FR)

( * ) Notice: Subject to any disclaimer, the term of this patent is extended or adjusted under 35 U.S.C. 154(b) by 0 days.

(21) Appl. No.: 09/284,899

(22) PCT Filed: Oct. 27, 1997

(86) PCT No.: PCT/FR97/01925

§ 371 Date: Jun. 2, 1999

§ 102(e) Date: Jun. 2, 1999

(87) PCT Pub. No.: WO98/19361

PCT Pub. Date: May 7, 1998

(30) Foreign Application Priority Data

Oct. 25, 1996 (FR) ..... 96 13377

(51) Int. Cl.[7] ..... H01Q 7/04; H01Q 11/12

(52) U.S. Cl. ..... 343/842; 343/741; 343/788; 343/866

(58) Field of Search ..... 343/841, 842, 343/741, 742, 745, 787, 788, 789, 866, 867, 872; H01Q 7/04, 11/12

(56) References Cited

U.S. PATENT DOCUMENTS

| | | |
|---|---|---|
| 4,083,006 | 4/1978 | Yokoshima . |
| 4,288,794 | 9/1981 | Osborne . |
| 5,248,989 | 9/1993 | Murdoch . |
| 5,257,033 | 10/1993 | Roche . |

FOREIGN PATENT DOCUMENTS

| | | |
|---|---|---|
| 2745928 | 9/1997 | (FR) . |

*Primary Examiner*—Don Wong
*Assistant Examiner*—Hoang Nguyen
(74) *Attorney, Agent, or Firm*—Roland Plottel

(57) ABSTRACT

A shielded magnetic-field antenna has at least one turn of a metallic element and metallic tubular shielding positioned around the element. The turn (3*a*) is produced in a printed circuit on a card made of insulating material (4*a*). The shielding has two open rings (5*a*, 6*a*) each produced in a printed circuit and disposed respectively on a bottom card (9*a*) and a top card (10*a*) made of insulating material. The cards are assembled by gripping the turn between the top and bottom cards. A plurality of metallic vias (7*a*, 8*a*) connect side edges of the two rings. The vias extend through the cards, and are positioned around the turn.

12 Claims, 4 Drawing Sheets

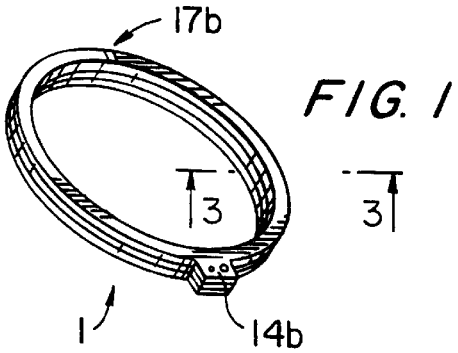
FIG. 1
FIG. 2
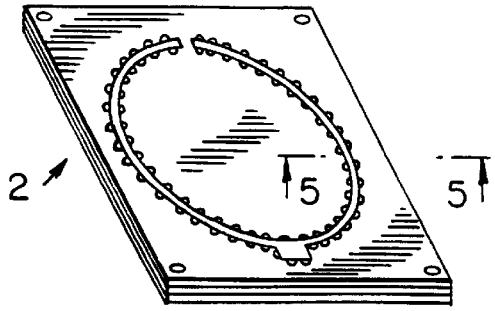
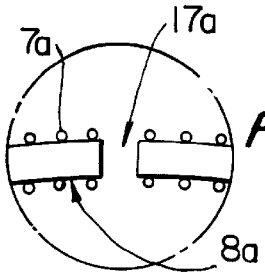
FIG. 9a
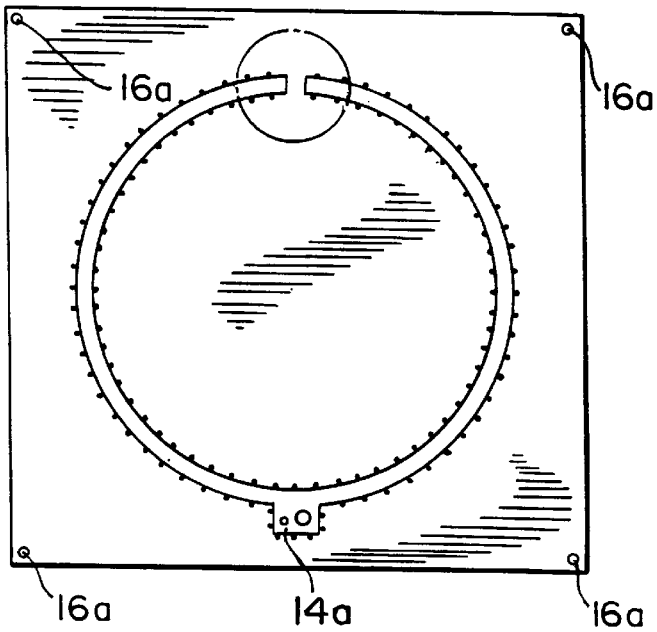
FIG. 9

ARMORED MAGNETIC FIELD ANTENNA IN PRINTED CIRCUIT

The present invention relates to a shielded magnetic-field antenna of the type having at least one turn of a metallic element and a metallic tubular shielding disposed around the said element.

It relates in particular to an antenna intended to be used in association with a chip card reader of the contactless type.

Two kinds of antenna of the above type are notably known. One, usually referred to as a coaxial cable, is flexible, the shielding consisting of a metallic braid disposed around a conducting wire sheathed with plastic; the other comprises shielding consisting of a rigid metallic tube, made from copper for example, disposed around a conducting wire also sheathed with plastic.

Producing these antennas has the drawback of requiring manual operations which are expensive and cannot be faithfully reproduced, such as an operation of cutting the coaxial wire or copper tube to the correct length, cutting the shielding in the middle of the loop opposite the location of a connection to an appliance, and then operations of soldering the antenna to a connector and to a frequency tuning system.

In addition, because of their design and the manual operations which they require, it has been found that such antennae exhibit disparities in magnetic characteristics compared with each other. The inventors deduced therefrom that they were not sufficiently reproducible geometrically.

Disparities in characteristics can also exist in an antenna when it is subjected to impacts or mechanical vibrations which cause it to change geometrically.

The consequence of these disparities, in the first case, is to make unsuitable a frequency tuning system with very fine adjustment designed to equip a series of antennae.

In the other case, the consequence of these disparities is to disturb the antenna with respect to a frequency adjustment made during the manufacture or after this by means of an associated frequency tuning system.

This type of antenna used in a metallic environment requires the association of a ferrite element and a metallic screen disposed underneath so as to give it immunity against surrounding magnetic field interference.

Because of its fragility, the ceramic element must be protected from vibrations and impacts which may occur against the antenna or screen. It is therefore necessary to provide an assembly of the whole which protects the breakable element.

At the present time, the antenna and ceramic element are embedded in resin. This has the drawback of being inconvenient and expensive to implement. In addition, the antenna obtained is not geometrically reproducible.

The present invention aims to mitigate the drawbacks set out above.

The objective of the invention is therefore to design an antenna which is reproducible, geometrically stable and of low cost.

Another objective of the invention is to design an antenna able to be used in a metallic environment which is insensitive to vibration and shock and whose design affords easy, reproducible and economical manufacture.

To this end, according to a preferred embodiment, the object of the invention is a shielded magnetic-field antenna having at least one turn of a metallic element and metallic tubular shielding disposed around the said element.

It is characterised in that the turn is produced in a printed circuit on a card made of insulating material, such as a printed-circuit card, and in that the said shielding consists on the one hand of two open rings, produced in a printed circuit, and disposed respectively on a bottom card and a top card made of insulating material, the said cards being connected by clamping the turn, and on the other hand a plurality of metallic vias distributed on each side of the turn, the said vias connecting the edges of the two rings through the said cards. These vias are preferably uniformly distributed.

By virtue of such a design, the antenna is very rigid, and therefore very stable geometrically compared with the antennae of the prior art.

According to another embodiment, for reasons of efficiency at low frequencies, the said shielding consists on the one hand of two open rings, produced in a printed circuit, and disposed respectively on a bottom annular support and a top annular support made of insulating material, the said supports gripping the turn, and on the other hand two metallic films connecting the edges of the two rings on each side of the turn, the said films being deposited on the edges of the annular support.

By virtue of the characteristics of the above two embodiments, the antenna can be manufactured on an industrial scale by the printed-circuit technique. This technique, perfectly mastered, ensures good reproducibility of its geometric characteristics. This can be effected at lesser cost since the manufacture uses production tools which are generally standardised and automated.

In addition, this design makes it possible to change the format of the antenna very easily since the majority of the operations are automated.

Another object of the invention is a device with a magnetic-field antenna including a printed-circuit antenna according to the invention, a ferrite layer, a metallic screen, two flexible leaves disposed respectively between the antenna and the ferrite layer on the one hand and between the ferrite layer and the metallic screen on the other hand. These leaves can have an adhesive on their faces in order to facilitate assembly.

The design of this device by assembling diverse layers has the advantage of adapting the antenna very easily to a metallic environment subjected to mechanical impacts or vibrations.

According to other preferred characteristics, the device can include clamping means for assembling and clamping together the ferrite layer, the flexible leaves and the metallic screen.

By virtue of these provisions, the elements can easily be connected together and if necessary dismantled, and the distance separating them checked.

According to other preferred characteristics, the device has means for keeping the ferrite at a distance from the antenna and keeping the screen at a distance from the ferrite.

By virtue of these provisions, the reproducibility of the geometric parameters of the device is also ensured.

Other characteristics and advantages of the invention will emerge from the following description, given solely by way of example, in no way limitative, referring to the accompanying drawings, in which:

FIG. 1 depicts an antenna according to a first embodiment;

FIG. 2 depicts an antenna according to another embodiment;

FIG. 9 depicts a detailed plan view of the antenna according to FIG. 2;

Figure 10:
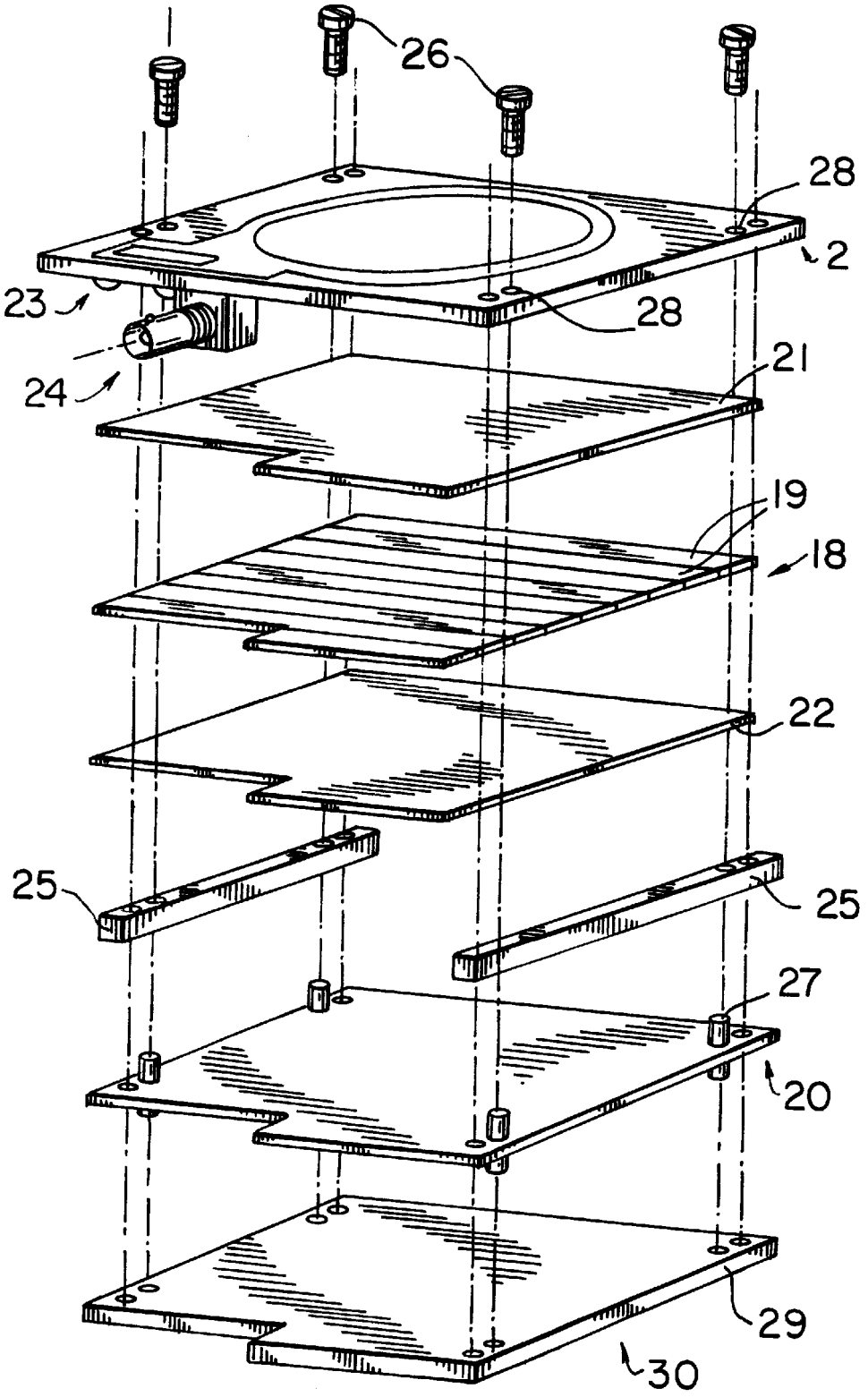

FIG. 9*a* is an enlarged detail, of a portion of the antenna of FIG. 9;

FIG. 10 depicts a disassembled view illustrating the assembly of the different constituents of the antenna device according to the invention.

In FIGS. 1 and 2, first and second embodiments of an antenna according to the invention can be seen respectively. A description will be given first of all of the first embodiment with the help of FIGS. 1, 3 and 4.

According to a first embodiment, the antenna has a general loop shape and has a rectangular cross section A—A. This cross section helps to reinforce its geometric stability. Preferably the loop is circular as in the example.

In accordance with the invention, the shielded magnetic-field antenna has at least one turn 3*b* of a metallic element and metallic tubular shielding 5*b*, 6*b*, 7*b*, 8*b* disposed around the said element.

In the example, the antenna has a single thin flat copper element 3*b*, disposed at the centre of a tubular structure with a rectangular cross section 5*b*, 6*b*, 7*b*, 8*b*. The element 3*b* is sandwiched between two rings 9*b*, 12*b* made of insulating material and with a rectangular cross section 10*b*, 9*b*, preferably with the same thickness. In this case the insulating material is epoxy glass.

On each side of the element 3*b*, between the two rings 9*b*, 12*b*, another insulant such as air can be found, or an adhesive connecting the two rings.

According to one variant, one of the two rings 12*b* consists of two rings 4*b* and 10*b* connected together (FIG. 4), for example by gluing.

As for the tubular shielding, this consists of a thin metallic film, for example a 35 $\mu$m copper film.

In FIG. 1, it can be seen that the shielding ring is open. It has a break 17*b* forming an air gap necessary to the correct functioning of the antenna in accordance with a known teaching, the said air gap being disposed opposite the connection points 14*b* of the antenna so that the shielding arms have strictly the same length.

Figure 3:
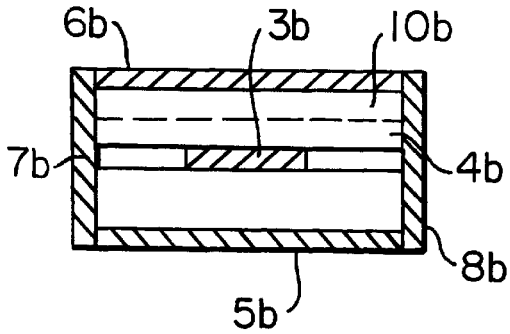
FIG. 3 is a transverse section of the antenna of FIG. 1 along 3—3, illustrating its cross section.
Figure 4:
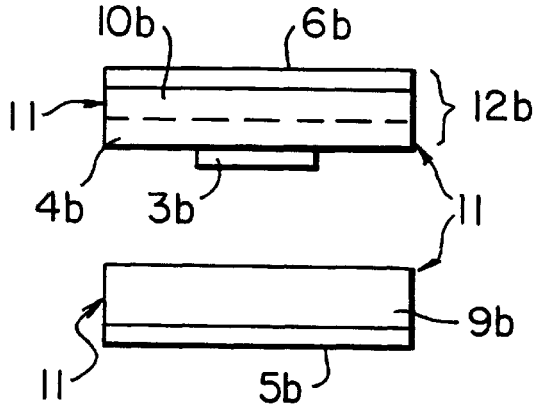
FIG. 4 is a transverse section of the antenna according to FIG. 3, this being in the course of assembly.

In FIGS. 3 and 4, it can be seen that the antenna has at least two annular insulating supports: a first top support 4*b* having the turn 3*b* on one of its parallel faces, a portion 6*b* of the shielding being on the other face, and a second bottom support 9*b* having solely a portion 5*b* of the shielding.

Once the two annular supports have been assembled, for example by gluing, their edge 11 receives a metallisation 7*b*, 8*b* which connects the portions 6*b* and 8*b* of each side of the element. The metallisation can be effected by any thin film deposition method, for example by spraying or mechanical deposition.

These metallic elements and the supports are advantageously printed-circuit elements. Consequently, it will be understood that producing the shielding uses the technique of printed-circuit manufacture.

According to a variant, only the turn 3*b* is produced initially, the metallic film 5*b* to 8*b* is being produced together thereafter, for example by spraying.

Another preferred embodiment will now be described with the help of FIGS. 2, 5, 6.

According to this embodiment, the antenna 1 has a general continuous shape in block form, which affords very good geometric stability.

Figure 5:
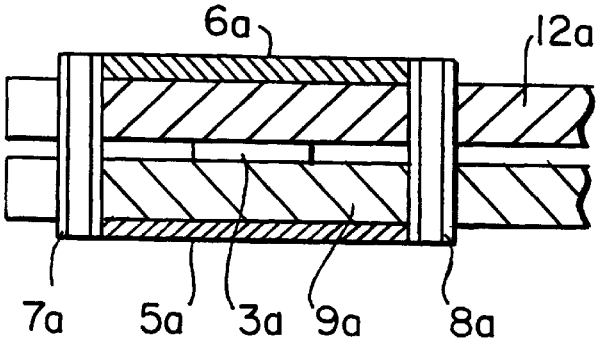
FIG. 5 is a transverse section of the antenna of FIG. 2 along 5—5, illustrating its cross section.
Figure 6:
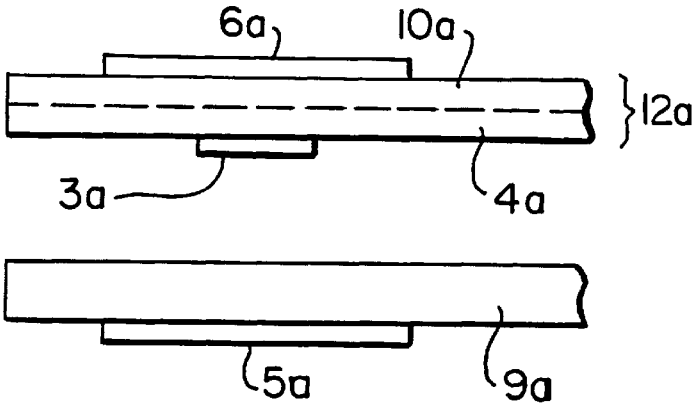
FIG. 6 is a transverse section of the antenna according to FIG. 5, this being in the course of assembly.

It consists of several cards made of insulating material, three in FIG. 2 or preferably two in FIGS. 5 and 6.

In the same way as before, it has a turn of a metallic element 3*a* and a metallic tubular shielding 5*a*, 6*a*, 7*a*, 8*a* disposed around the said element.

The turn is identical to the turn in the previous example. On the other hand, there are differences in the support and the lateral walls of the shielding. The supports are continuous cards whilst the lateral walls consist of a plurality of metallic vias 7*a* and 8*a* connecting the two rings 5*a* and 6*a*.

These vias or cross members are distributed on each side of the turn 3*a* along the latter (FIG. 9). Preferably, these vias are spaced apart by as small a distance as possible so as to be effective at low frequencies. In the example, this distance is equal to 2.5 mm, the diameter of the vias being 0.5 mm; this distance gives the antenna a good efficiency/strength ratio in this example, which relates to the reading of contactless chip cards.

The vias pass through the cards 9*a*, 12*a* and electrically connect the lateral edges of the metallic rings of the shielding.

As before, the card 12*a* carrying the turn can be produced from two distinct cards 4*a*, 10*a* (FIG. 6) connected by gluing subsequently or from a single card 12*a*, whilst the other card 9*a* carries solely a bottom portion of the screening 5*a*.

As before, it can be seen in FIG. 6, according to a preferred embodiment, that the turn 3*a* and the ring 6*a* are produced first of all on the same printed circuit card 12*a*, whilst the other ring is also produced in a printed circuit on another card.

These cards 9*a* and 12*a* are then assembled, for example by gluing.

In a last operation, orifices are pierced all along the lateral edges of the metallic rings in which vias 7*a*, 8*a* are produced, like the ones normally used in the production of printed circuits. These vias can be replaced by any kind of elongate metallic element providing the same electrical connection function, for example hollow or solid rivets.

Advantageously, the plurality of vias constitute a perforated wall of the screening in the same way as a braid of a coaxial cable; it therefore fulfills a similar function.

Through the rigidity and geometric stability of the printed circuit cards, a particularly stable and reproducible antenna is obtained.

Advantageously, the location 14*a* of the connection and the location of the tuning circuit 13*a* are effected on the same support as that of the antenna.

Figure 7:
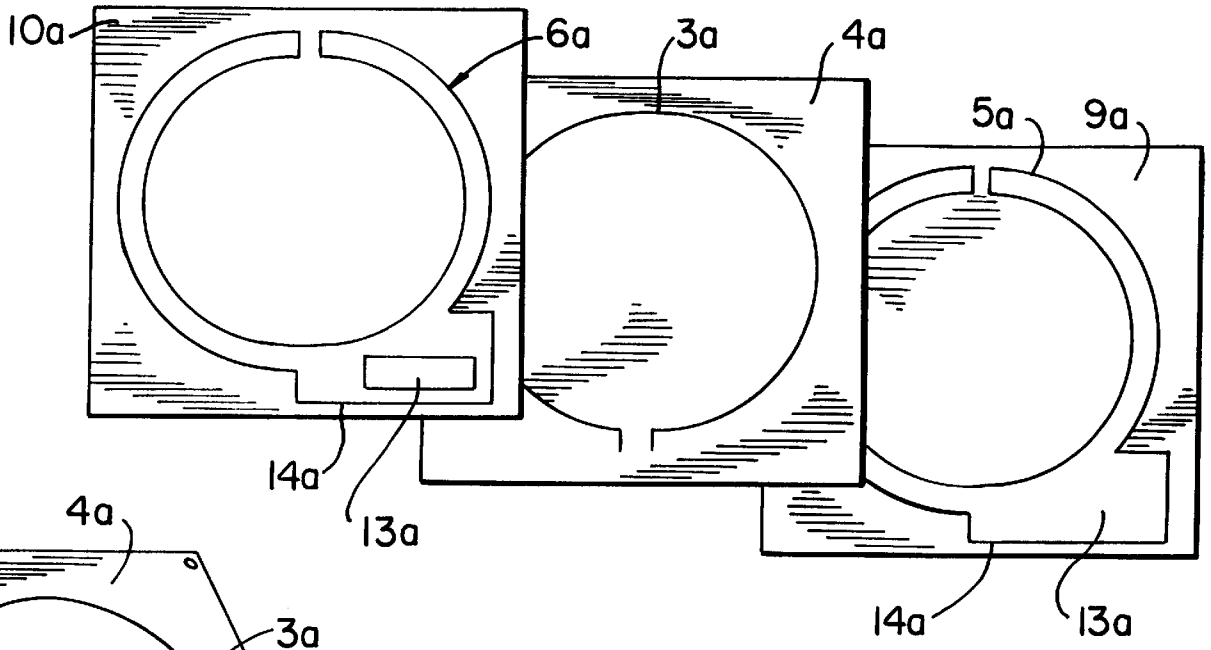
FIG. 7 depicts printed-circuit cards used for producing the antenna with the location of a complementary circuit.

FIG. 7 illustrates the metallisations produced on three printed circuit cards 10*a*, 4*a* and 9*a*. At least three metalisations are necessary: one metallisation for the top ring of the shielding 6*a* and for complementary circuit elements 13*a* such as the location of a tuning circuit 14*a* and of a connector 15*a*, another metallisation 3*a* for the turn, and a last one for the ring 6*a* and the above complementary circuit elements 13*a*.

Thus it is possible to create the antenna and its complementary electrical circuit elements in three printing operations. It suffices thereafter to assemble the three cards produced separately, to place the vias on the card in an automated fashion, and then to connect it and the components of the tuning circuit including at least one variable capacitor with very fine adjustment.

The card can have orifices 16*a* enabling metallic inserts such as spacers to be introduced subsequently.

By virtue of the use of a widespread manufacturing method, it is possible to produce such an antenna easily and rapidly on an industrial scale. In addition, it is also easy to change format according to the envisaged applications.

Figure 8:
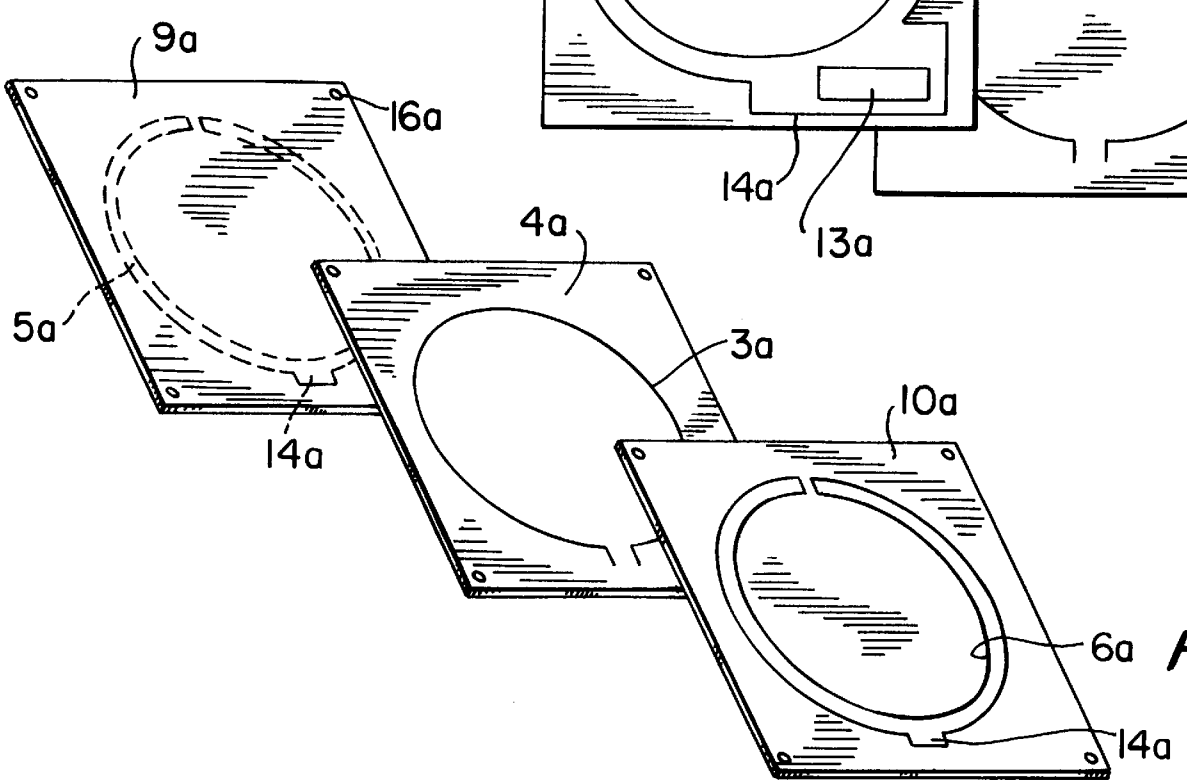
FIG. 8 depicts the constituents of the antenna of FIG. 2.

FIG. 8 illustrates the three printed-circuit cards 4*a,* 9*a,* 10*a* obtained here without the location of the tuning circuit. On the other hand, they have respectively a ring 5*a* with a location 14*a* for receiving a connector, a turn 3*a* and a ring 6*a* with another location 14*a*.

In FIG. 9 and FIG. 9*a,* it can be seen that the vias 7*a,* 8*a* are distributed along edges of the ring and that the latter has an air gap 17*a,* disposed diametrically opposite the connecting points 14*a*.

In FIG. 10, a magnetic-field antenna device 30 includes a printed-circuit antenna 2. In the example, it is a case of the antenna according to the invention. In this figure the antenna is equipped with its tuning circuit 23 and a connector 24.

The device 30 also has shielding by means of a material able to channel electromagnetic waves, such as for example a ferrite plate 18 consisting of a set of flat ferrite bars 19 disposed against each other and a screen against electromagnetic waves such as a steel plate 20.

The assembly consisting of ferrite and screen is disposed successively below the antenna 2 in FIG. 10; they must be interposed between the antenna and the metallic surroundings. Such an arrangement isolates the antenna from a metallic environment which could disturb it.

According to the invention, the ferrite assembly 18 is isolated from the antenna 2 of the invention by means of a leaf 21 of non-magnetic compressible material able to damp the mechanical vibrations or impact. The same material, in the form of a leaf or layer 22, is disposed between the screen 20 and the ferrite assembly. The material can be compact such as rubber or Neoprene-based foam.

In the example, Neoprene foam leaves have been used, advantageously having adhesive faces so as to facilitate mounting.

Thus it is possible to assemble different breakable elements such as ferrite or ceramic with a printed circuit element such as the antenna 2 of the invention.

The antenna device 30 can also have remote adjustment means 25 for more precisely controlling the distances between the different layers formed by the printed-circuit antenna, the ferrite and the screen. They can also have clamping means 26, 27 for controlling the damping and the clamping together of the layers.

In the example, the antenna device 30 has spacer pads 25 made from a denser material than the foam, for example ten times denser and therefore ten times less compressible under the same pressure, this being disposed laterally between the steel screen 20 and the printed circuit 2 so as to keep a substantially constant distance between them. The pads 25 can have orifices to enable the clamping means mentioned below to pass.

The antenna device preferably has assembly and clamping means consisting in the example of four screws 26 and corresponding nuts 27 disposed at the four corners of the antenna 2, the nuts being integrally fixed to the screen.

As a variant, sockets 27 can be used which have the function of nut and spacer. Thus, in tightening the screws completely there is always the same separation and the same compression of the leaves. The antenna 2 can also have annular metallic inserts 28 which serve both as a washer from the screws 26 and which have a function of spacer for the printed-circuit card.

Where applicable, the antenna can have a sole plate 29 made of non-magnetic flexible material such as rubber on which the complete antenna can bear whilst being isolated from the vibrations of the receiving support.

By virtue of these characteristics, the antenna is geometrically stable, since it is not disturbed by impacts or vibrations. In addition, the breakable elements being protected, it offers excellent mechanical strength.

Moreover, it is possible to manufacture it simply by assembling, and this in a reproducible fashion.

In this application, the adjustable capacitors of the tuning circuit can also be chosen with a very fine adjustment.

What is claimed is:

1. A shielded magnetic-field antenna having a turn (3*b*) of a metallic element and metallic tubular shielding (5*b,* 6*b,* 7*b,* 8*b*) disposed around said element, characterized in that the turn (3*b*) is produced in a printed circuit on a first annular support made of insulating material (4*b*), and in that said shielding comprises two open metallic rings (5*b,* 6*b*) produced in a printed circuit respectively on a bottom annular support (9*b*) and a top annular support (10*b*) made of insulating material, said top and bottom supports gripping the turn, and two metallic films (7*b,* 8*b*) connecting the two rings on each side of the turn, said metallic films being deposited on side edges (11) of the annular supports.

2. An antenna according to claim 1, characterized in that the turn (3*b*) and one of said rings (6*b*) are disposed on a common annular support (12*b*).

3. A shielded magnetic-field antenna (2) having at least one turn (3*a*) of a metallic element and metallic tubular shielding (5*a,* 6*a,* 7*a,* 8*a*) disposed around said element, characterized in that the turn (3*a*) is produced in a printed circuit on a card made of insulating material (4*a*) and in that said shielding comprises two open rings (6*a*) produced in a printed circuit and disposed respectively on a bottom card (9*a*) and a top card (10*a*) made of insulating material, said top and bottom cards (9*a,* 10*a*) being assembled by clamping the turn (3*a*), and a plurality of metallic vias (7*a,* 8*a*) connecting the edges of the two rings (5*a,* 6*a*) through said cards, said vias being distributed on each side of the turn.

4. An antenna according to claim 3, characterized in that the turn (3*a*) and one of said rings (5*a,* 6*a*) are disposed of a command card (12*a*).

5. The antenna according to claim 4 wherein the vias (7*a,* 8*a*) are spaced apart by a distance of approximately 1.5 mm.

6. The antenna according to claim 4 wherein the printed-circuit card also has an location (13*a,* 14*a*) for a tuning system (33) and for a connection (24).

7. An antenna according to claim 3, characterised in that the vias (7*a,* 8*a*) are spaced apart by a distance of approximately 1.5 mm.

8. The antenna according to claim 7 wherein the printed-circuit card also has an location (13*a,* 14*a*) for a tuning system (33) and for a connection (24).

9. An antenna according to claim 3, characterised in that the printed-circuit card also has a location (13*a,* 14*a*) for a tuning system (33) and for a connection (24).

10. A magnetic-field antenna device (30) having a printed-circuit antenna (2) according to one of the preceding claims 1, 2, 3, or 4, further comprising a ferrite layer (18), a metallic screen (2), two flexible leaves (21, 22) disposed respectively between the antenna (2) and the ferrite layer, and between the ferrite layer and the metallic screen.

11. The device according to claim 10, further comprising clamping means (26, 27) for assembling and clamping together the antenna (2), the ferrite layer (18), the flexible leaves (21, 22) and the screen (20).

12. The device according to claim 11 further comprising spacers (25, 27, for keeping the ferrite (18) at a distance from the antenna (2) and keeping the screen (20) at a distance from the ferrite (18).

* * * * *